US005439604A

United States Patent [19]

Waddoups et al.

[11] Patent Number: 5,439,604

[45] Date of Patent: Aug. 8, 1995

[54] OIL SOLUBLE ADDITIVES USEFUL IN OLEAGINOUS COMPOSITIONS

[75] Inventors: Malcolm Waddoups, Westfield; Jacob Emert, Brooklyn, both of N.Y.; Antonio Gutierrez, Mercerville; Robert D. Lundberg, Bridgewater, both of N.J.

[73] Assignee: Exxon Chemical Patents Inc., Linden, N.J.

[21] Appl. No.: 182,875

[22] Filed: Jan. 14, 1994

Related U.S. Application Data

[63] Continuation of Ser. No. 335,644, Apr. 10, 1989, abandoned, which is a continuation of Ser. No. 940,984, Dec. 12, 1986, abandoned.

[51] Int. Cl.[6] ..... C10M 129/26

[52] U.S. Cl. ..... 252/32.7 E; 252/33.2; 252/46.4; 252/51.5 R; 252/51.5 A; 252/56 R

[58] Field of Search ..... 252/32.7 E, 33.2, 515 A, 252/56 R

[56] References Cited

U.S. PATENT DOCUMENTS

| | | | |
|---|---|---|---|
| 2,343,756 | 3/1944 | Downing et al. | 252/42.7 |
| 2,356,661 | 8/1944 | Downing et al. | 252/37 |
| 3,271,310 | 9/1966 | Le Suer | 252/35 |
| 3,346,493 | 10/1967 | Le Suer | 252/32.5 |
| 3,489,682 | 1/1970 | Le Suer | 252/32.7 |
| 3,522,179 | 7/1970 | Le Seur | 252/51.5 |
| 3,632,510 | 1/1972 | Le Suer | 252/35 |
| 3,714,042 | 1/1973 | Greenough | 252/33.2 |
| 3,927,041 | 12/1975 | Cengel et al. | 260/346.8 |
| 4,062,786 | 12/1977 | Brois et al. | 252/51.5 R |
| 4,113,639 | 9/1978 | Lonstrup et al. | 252/51.5 A |
| 4,116,876 | 9/1978 | Brois et al. | 252/49.6 |
| 4,123,373 | 10/1978 | Brois et al. | 252/48.6 |
| 4,552,677 | 11/1985 | Hopkins | 252/33.6 |
| 4,751,011 | 6/1988 | Lundberg et al. | 252/35 |
| 4,801,390 | 1/1989 | Robson | 252/25 |
| 4,870,197 | 9/1989 | Gutierrez et al. | 556/114 |

FOREIGN PATENT DOCUMENTS

| | | |
|---|---|---|
| 895398 | 3/1972 | Canada . |
| 1189307 | 6/1985 | Canada . |
| 024146 | 2/1981 | European Pat. Off. . |
| 2116583 | 9/1983 | United Kingdom . |

*Primary Examiner*—Ellen M. McAvoy
*Attorney, Agent, or Firm*—Mary M. Allen

[57] ABSTRACT

This invention is to compositions containing metal salts, preferably copper or zinc salts, of polyalkenyl substituted monounsaturated mono- or dicarboxylic acids which may be used as a compatibilizing material for mixtures of high molecular weight dispersants, high total base number detergents, and various antiwear or antioxidant materials.

38 Claims, No Drawings

OIL SOLUBLE ADDITIVES USEFUL IN OLEAGINOUS COMPOSITIONS

This is a continuation, of application Ser. No. 335,644, filed Apr. 10, 1989, now abandoned, which is a continuation of U.S. application Ser. No. 940,984, filed Dec. 12, 1986, now abandoned.

FIELD OF THE INVENTION

This invention relates to oil soluble additives useful in fuel and lubricating oil compositions, and particularly to concentrates or lubricating compositions containing said additives, and methods for their manufacture and use. The additives are various metal salts of mono-or dicarboxylic acids which have been substituted with a high molecular weight hydrocarbon group, or metal salts of the derivatives of polyolefin mono- or dicarboxylic acids, anhydrides, or esters such as amides, imides, esters, oxazolines, etc., formed by further reaction with amine, alcohol, amino alcohols, and which may be further treated, e.g. borated. The high molecular weight ($M_n$) of the polyolefin is generally greater than about 700. The metal salt compatibility additives are especially useful in stabilizing (or "compatibilizing") concentrates, lubricating oil or fuel oil compositions which contain high molecular weight dispersants, high total base number ("TBN") detergents, and various antiwear or antioxidant materials. These salts may be useful in replacing at least a portion of previously used compatibility agents, antioxidants and dispersants.

BACKGROUND OF THE INVENTION

Canadian Pat. No. 895,398 discloses reacting a mole of an unsaturated hydrocarbon group of 700 to 10,000 molecular weight with 1 to 1.5 moles of chloro-substituted maleic or fumaric acid, which material can then be further reacted with alcohol.

U.S. Pat. No. 3,927,041 discloses reacting a mole of 300 to 3,000 molecular weight polybutene containing 5 to 200 ppm 1,3 dibromo-5,5-dialkylhydantoin as a catalyst reacted with 0.8 to 5, generally 1.05 to 1.15 moles of dicarboxylic acid or anhydride, to form materials which can be used per se, or as esters, amides, iraides, amidines, in petroleum products.

U.S. Pat. No. 3,215,707 discloses reacting chlorine with a mixture of polyolefin up to 50,000 molecular weight, especially of 250 to 3,000 molecular weight with one or more moles of maleic anhydride depending upon whether one or more succinic anhydride radicals are to be in each polymer molecule.

U.S. Pat. Nos. 4,113,639 and 4,116,876 disc lose an example of alkenyl succinic anhydride having a molecular weight of the alkenyl group of 1,300 and a Saponification Number of 103 (about 1.3 succinic anhydride units per hydrocarbon molecule). This alkenyl succinic arthydride may be reacted with polyamine and then boric acid ('639), or may be reacted with amino alcohol to form an oxazoline ('876) which is then borsted by reaction with boric acid.

U.S. Pat. No. 4,062,786 in Example 13 shows a polyisobutenyl succinic anhydride of molecular weight of about 1,300 and a Saponification Number of about 100 (about 1.25 succinic anhydride units per alkenyl group).

U.S. Pat. No. 4,123,373 in Example 3 shows a polyisobutenyl succinic anhydride of about 1,400 molecular weight having a Saponification Number of 80 (about 1.07 succinic anhydride units per polyisobutylene units).

Certain metal salts of alkenyl succinic acid are known. For instance, U.S. Pat. No. 3,271,310 teaches that a "metal salt of hydrocarbon-substituted succinic acid having at least 50 aliphatic carbon atoms as the hydrocarbon substituent, the metal of the metal salt being selected from the class consisting of Group I metals, Group II metals, aluminum, lead, tin, cobalt and nickel" is useful as a dual purpose additive.

Similarly, U.S. Pat. No. 4,552,677 discloses a similar material in which the preferred metal in the salt is copper and the hydrocarbon substituent contains from 8 to 35 carbon atoms.

U.S. Pat. No. 4,234,435 discloses that certain of the salts disclosed in U.S. Pat. No. 3,271,310 are useful as dispersant/detergents and viscosity improving agents in lubricating oil compositions. The salts include those in which the polybutene moiety had a $H_n$ of from about 1,300 to about 0 a $M_w/M_n$ ratio of between 1.5 and 4.0 and in which the ratio of the succinic moiety to the polybutene substituent is at least 1.3.

U.S. Pat. No. 3,714,042 relates to the treatment of basic metal sulfonate complexes, sulfonatecarboxylate complexes and carboxylate complexes with high molecular weight carboxylic acids to prepare additives useful in lubricating oils and gasolines. The patentee teaches the ineffectiveness of preformed metal salts of high molecular weight carboxylic acids for such treatments, and exemplifies the sediment formation resulting from use of the calcium salt of polyisobutenyl succinic anhydride at low concentrations in a mineral lubricating oil.

SUMMARY OF THE INVENTION

The present invention is directed to compositions containing an additive comprising metal salts of the product of a polyolefin of at least 700 number average molecular weight ($M_n$) substituted with a mono- or dicarboxylic acid producing moiety per polyolefin molecule. The preferred salts are copper and zinc salts. Although the material is useful per se as an additive, e.g., as a dispersant, it is particularly useful as a comparability aid in lubricating compositions containing high molecular weight dispersants, high total base number detergents, antiwear agents, and antioxidants. It has been found that these salts may also be substituted for at least some of these detergents, dispersants, and antioxidant additives.

The compositions of the invention are different from the prior art in that they are quite stable even after storage at elevated temperatures.

DESCRIPTION OF THE PREFERRED EMBODIMENTS

Lubricating oil compositions, e.g. automatic transmission fluids, heavy duty oils suitable for gasoline and diesel engines, etc., can be prepared using the compositions of this invention. Universal type crankcase oils, those in which the same lubricating oil compositions are used for either gasoline or diesel engines, may also be prepared. These lubricating oil formulations conventionally contain several different types of additives that will supply the characteristics that are required for the particular use. Among these types of additives are included viscosity index improvers, antioxidants, corrosion inhibitors, detergents, dispersants, pour point depressants, antiwear agents, etc.

In the preparation of lubricating oil formulations, it is common practice to introduce the additives in the form of a concentrate (for instance, as an "adpack") containing 10 to 80 weight percent, e.g., 20 to 80 weight percent, active ingredient in a solvent. The solvent may be a hydrocarbon oil, e.g., a mineral lubricating oil, or other suitable material. In forming finished lubricants, such as crankcase motor oils, these concentrates, in turn, may be diluted with 3 to 100, preferably 5 to 40, parts by weight of lubricating oil per part by weight of the additive package. One uses concentrates, of course, to make the handling of the various constituent materials less difficult as well as to facilitate solution of or dispersion of those materials in the final blend. Blending of a lubricating oil composition containing several types of additives typically causes no problems if each additive is added separately. However, when an additive "package" having a number of additives in a single concentrate is to be-used, the additives may interact with each other. For instance, high molecular weight dispersants have been found to interact with various other additives in the concentrate, particularly overbased metal detergents and antioxidants, such as copper oleate, to cause phase separation. Obviously, this may hamper pumping, blending and handling of both the concentrate and the resulting product. Although the concentrate may be further diluted to reduce the interaction effect, the dilution increases shipping, storage and handling costs. Storage of the concentrate provides a problem in that the concentrate itself may separate in to a number of phases during that storage. The preferred high molecular weight hydrocarbyl mono- and dicarboxylic acid metal salts discussed below substantially alleviate these phase separation problems. Indeed, these salts may be used as substitutes for all or part of the other dispersant and antioxidant additives included in a concentrate or lubricating oil formulation.

THE COMPOSITIONS

Compositions made according to this invention generally will contain one or more:

a. high molecular weight dispersants,
b. detergents having a high total base number,
c. antiwear additives, and
d. compatibility agents of the metal salts of high molecular weight alkenyl substituted mono- or dicarboxylic acids, or metal salts of the derivatives of mono- or dicarboxylic acids substituted with polyolefinic residues, such as amides, imides, anhydrides or esters.

Depending upon the use to which the compositions are ultimately placed, the compositions may also include antioxidants, friction modifiers, and the like.

The compositions of this mixture contain at least four active agents listed separately above (and which are discussed separately below) in amounts effective to provide their respective functions.

When the compositions of the invention are used in the form of lubricating oil compositions, such as automotive crankcase lubricating oil compositions, a major amount of a lubricating oil may be included in the composition. Broadly, the composition may contain about 85 to about 99.99 weight of a lubricating oil. Preferably, about 93 to about 99.8 weight percent of the lubricating oil. The term "lubricating oil" is intended to include not only hydrocarbon oils derived from petroleum but also synthetic oils such as alkyl esters of dicarboxylic acids, polyglycols and alcohols, polyalphaolefins, alkyl benzenes, organic esters of phosphoric acids, polysilicone oils, etc.

When the compositions of this invention are provided in the form of concentrates, with or without the other noted additives, a minor amount, e.g., up to about 50 percent by weight, of a solvent, mineral or synthetic oil may be included to enhance the handling properties of the concentrate.

THE DISPERSANT

The dispersant preferred in this inventive composition is a long chain hydrocarbyl substituted mono-or dicarboxylic acid material, i.e., acid, anhydride, or ester, and includes a long chain hydrocarbon, generally a polyolefin, substituted with acrylic acid or an alpha or beta unsaturated $C_4$ to $C_{10}$ mono or dicarboxylic acid, such as itaconic acid, maleic acid, maleic anhydride, chloromaleic acid, dimethyl fumarate, chloromaleic anhydride, acrylic acid, methacrylic acid, crotonic acid, cinnamic acid, etc., per mole of polyolefin. Preferably, the dispersant contains at least about 1.05 moles (e.g., 1.05 to 1.2 moles, or higher) of the acid per mole of polyolefin.

Preferred olefin polymers for the reaction with the unsaturated dicarboxylic acids are those polymers made up of a major molar amount of $C_2$ to $C_{10}$,e.g., $C_2$ to $C_5$ , monoolefin. Such olefins include ethylene, propylene, butylene, isobutylene, pentene, octene-1, styrene, etc. The polymers may be homopolymers such as polyisobutylene or copolymers of two or more of such olefins. These include copolymers of: ethylene and propylene; butylene and isobutylene; propylene and isobutylene; etc. Other copolymers include those in which a minor molar amount of the copolymer monomers, e.g., 1 to 10 mole percent is a $C_4$ to $C_{18}$ diolefin, e.g., copolymer of isobutylene and butadiene; or a copolymer of ethylene, propylene and 1,4-hexadiene; etc.

In some cases, the olefin polymer may be completely saturated, for example an ethylene-propylene copolymer made by a Ziegler-Natta synthesis using hydrogen as a moderator to control molecular weight.

The olefin polymers will usually have number average molecular weights above about 700, including number average molecular weights within the range of from about 1,500 to about 5,000 with approximately one double bond per polymer chain. An especially suitable starting material for a dispersant additive is polyisobutylene. The number average molecular weight for such polymers can be determined by several known techniques. A convenient method for such determination is by gel permeation chromatography (GPC) which additionally provides molecular weight distribution information, see W. W. Yua, J. J. Kirkland and D. D. Bly, "Modern Size Exclusion Liquid Chromatography," John Wiley and Sons, New York, 1979.

Processes for reacting the olefin polymer with the $C_{4-10}$ unsaturated dicarboxylic acid, anhydride, or ester are known in the art. For example, the olefin polymer and the dicarboxylic acid material may be simply heated together as disclosed in U.S. Pat. Nos. 3,361,673 and 3,401,118 to cause a thermal "ene" reaction to take place. Or, the olefin polymer can be first halogenated, for example, chlorinated or brominated to about 1 to 8, preferably 3 to 7 weight percent chlorine, or bromine, based on the weight of polymer, by passing the chlorine or bromine through the polyolefin at a temperature of 100° to 250°, e.g., 120° to 160° C. for about 0.5 to 10, preferably 1 to 7 hours. The halogenated polymer may then be reacted with sufficient unsaturated acid or anhydride at 100° to 250°, usually about 180° to 220° C. for about 0.5 to 10, e.g., 3 to 8 hours. Processes of this general type are taught in U.S. Pat. Nos. 3,087,436; 3,172,892; 3,272,746 and others.

Alternatively, the olefin polymer, and the unsaturated acid material are mixed and heated while adding chlorine to the hot material. Processes of this type are disclosed in U.S. Pat. Nos. 3,215,707; 3,231,587; 3,912,764; 4,110,349; 4,234,435; and in U.K. Pat. No. 1,440,219.

By the use of halogen, about 65 to 95 weight percent of the polyolefin will normally react with the dicarboxylic acid material. Thermal reactions, those carried out without the use of halogen or a catalyst, cause only about 50 to 75 weight percent of the polyisobutylene to react. Chlorination obviously helps to increase the reactivity.

The dicarboxylic acid producing materials can also be further reacted with amines, alcohols, including polyols, amino-alcohols, etc., to form other useful dispersant additives. Thus, if the acid producing material is to be further reacted, e.g., neutralized, then generally a major proportion of at least 50 percent of the acid units up to all the acid units will be reacted.

Useful amine compounds for reaction with the hydrocarbyl substituted dicarboxylic acid material include mono- and polyamines of about 2 to 60, e.g., 3 to 20, total carbon atoms and about 1 to 12, e.g., 2 to 8, nitrogen atoms in a molecule. These amines may be hydrocarbyl amines or may be hydrocarbyl amines including other groups, e.g., hydroxy groups, alkoxy groups, amide groups, nitriles, imidazoline groups, and the like. Hydroxy amines with 1 to 6 hydroxy groups, preferably 1 to 3 hydroxy groups are particularly useful. Preferred amines are aliphatic saturated amines, including those of the general formulas:

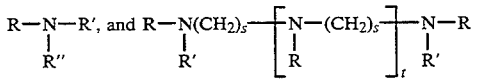

wherein R, R′ and R″ are independently selected from the group consisting of hydrogen; $C_1$ to $C_{25}$ straight or branched chain alkyl radicals; $C_1$ to $C_{12}$ alkoxy $C_2$ to $C_6$ alkylene radicals; $C_2$ to $C_{12}$ alkylamino $C_2$ to $C_6$ alkylene radicals; each s can be the same or a different number of from 2 to 6, preferably 2 to 4; and t is a number of from 0 to 10, preferably 2 to 7. At least one of R, R′ or R″ must be a hydrogen.

Non-limiting examples of suitable amine compounds include: 1,2-diaminoethane; 1,3-diaminopropane; 1,4-diaminobutane; 1,6-diaminohexane; polyethylene amines such as diethylene triamine; triethylene tetramine; tetraethylene pentamine; polypropylene amines such as 1,2-propylene diamine; di-(1,2-propylene) triamine; di-(1,3-propylene)-triamine; N,N-dimethyl-1,3diamino-propane; N,N-di-(2-aminoethyl) ethylene diamine; N,N-di(2-hydroxyethyl)-1,3-propylene diamine; 3-dodecyloxypropylamine; N-dodecyl-1,3-propane diamine; tris hydroxymethylaminomethane (THAM); diisopropanol amine; diethanol amine; triethanol amine; amino morpholines such as N-(3-amino-propyl) morpholine; etc.

Other useful amine compounds include: alicyclic cyclic diamines such as 1,4-di-(aminomethyl) cyclohexane, and heterocyclic nitrogen compounds such as imidazolines, and N-aminoalkyl piperazines of the general formula:

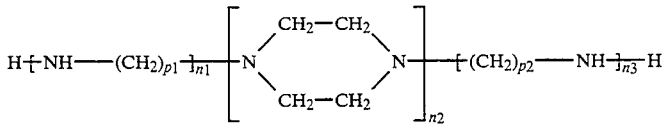

wherein $p_1$ and $p_2$ are the same or different and are each integers of from 1 to 4, and $n_1$, $n_2$ different and are each integers of from 1 to 3. Non-limiting examples of such amines include 2-pentadecyl imidazoline; N-(2-aminoethyl) piperazine; etc.

Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and corresponding piperazines. Low cost poly (ethyleneamine compounds averaging about 5 to 7 nitrogen atoms per molecular are available commercially under trade names such a "Polyamine H," "Polyamine 400," "Dow Polyamine E-100," etc.

Useful amines also include polyoxyalkylene polyamines such as those of the formulae:

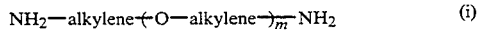

(i)

where "m" has a value of about 3 to 70 and preferably 10 to 35; and

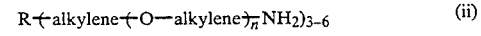

(ii)

where "n" has a value of about 1 to 40 with the provision that the sum of all the n's is from about 3 to about 70 and preferably from about 6 to about 35 and R is a saturated hydrocarbon radical of up to ten carbon atoms, wherein the number of substituents on the R group is from 3 to 6. The alkylene groups in either formula (i) and (ii) may be straight or branched chains containing about 2 to 7, and preferably about 2 to 4 carbon atoms.

The polyoxyalkylene polyamines above, preferably polyoxyalkylene diamines triamines, may have average molecular weights ranging from about 200 to about 4,000 and preferably from about 400 to about 2,000. The preferred polyoxylakylene polyamines include the polyoxyethylene and polyoxypropylene diamines and the polyoxypropylene triamines having average molecular weights ranging from about 200 to 2,000. The polyoxyalkylene polyamines are commercially available and may be obtained, for examples, from the Jefferson Chemical Company, Inc. under the trade name "Jeffamines D-230, D-400, D-1000, D-2000, T-403 ," etc.

The amine is readily reacted with the dicarboxylic acid material, e.g., alkenyl succinicanyhydride, by heating an oil solution containing 5 to 95 weight percent of dicarboxylic acid material to about 100 to 250° C., preferably 125° to 175° C., generally for 1 to 10, e.g.,2 to 6 hours, until the desired amount of water is removed. The heating is preferably carried out to favor formation of imides or mixtures of iraides and amides, rather than amides and salts. Reaction ratios can vary considerably, depending upon the reactants, amounts of excess amine, type of bonds formed, etc. Generally from 0.3 to 2, preferably about 0.3 to 1.0, e.g., 0.4 to 0.8 mole of amine, e.g., bis-primary amine is used, per mole of the dicarboxylic acid moiety content, e.g., grafted maleic anhydride content. For example, one mole of olefin reacted with sufficient maleic anhydride to add 1.10 mole of maleic anhydride groups per mole of olefin when converted to a mixture of amides and imides, about 0.55 moles of amine with two primary groups would preferably be used, i.e., 0.50 mole of amine per mole of dicarboxylic acid moiety.

The nitrogen containing dispersant can be further treated by boration as generally taught in U.S. Pat. Nos. 3,087,936 and 3,254,025 (the entirety of which is incorporated by reference).

The tris (hydroxymethyl) amino methane (THAN) can be reacted with the aforesaid acid material to form amides, imides or ester type additives as taught by U.K. Pat. No. 984,409, or to form oxazoline compounds and borated oxazoline compounds as described, for example, in U.S. Pat. Nos. 4,102,798, 4,116,876 and 4,113,639.

The ashless dispersants may also be esters derived from the long chain hydrocarbyl substituted dicarboxylic acid material and from hydroxy compounds such as monohydric and polyhydric alcohols or aromatic compounds such as phenols and naphthols, etc. The polyhydric alcohols are the most preferred hydroxy compound and preferably contain from 2 to about 10 hydroxy radicals, for example, ethylene glycol, diethylene glycol, triethylene glycol, tetraethylene glycol, dipropylene glycol, and other alkylene glycols in which the alkylene radical contains from 2 to about 8 carbon atoms. Other useful polyhydric alcohols include glycerol, mono-oleate of glycerol, monostearate of glycerol, monomethyl ether of glycerol, pentaerythritol, dipentaerythritol, ere.

The ester dispersant may also be derived from unsaturated alcohols such as allyl alcohol, cinnamyl alcohol, propargyl alcohol, 1-cyclohexane-3-ol, and oleyl alcohol. Still other classes of the alcohols capable of yielding the esters of this invention comprise the ether-alcohols and amino-alcohols including, for example, the oxy-alkylene, oxy-arylene-, amino-alkylene-, and amino-arylene-substituted alcohols having one or more oxy-alkylene, amino-alkylene or amino-arylene or amino-arylene oxy-arylene radicals. They are exemplified by Cellosolve, Carbitol, N,N,N',N'-tetrahydroxytrimethylene di-amine, and ether-alcohols having up to about 150 oxyalkylene radicals in which the alkylene radical contains from 1 to about 8 carbon atoms.

The ester dispersant may be di-esters of succinic acids or acidic esters, i.e., partially esterilied succinic acids; as well as partially esterified polyhydric alcohols or phenols, i.e., esters having free alcohols or phenolic hydroxyl radicals. Mixtures of the above illustrated esters likewise are contemplated within the scope of this invention.

The ester dispersant may be prepared by one of several known methods as illustrated for example in U.S. Pat. No. 3,381,022.

Mannich base type dispersants such as those described in U.S. Pat. Nos. 3,649,229 and 3,798,165 (the disclosures of which are hereby incorporated by reference in their entirety) may also be used in these compositions. Such Mannich base disperants can be formed by reacting a high molecular weight, hydrocarbyl-substituted mono- or polyhydroxy benzene (e.g., having a number average molecular weight of 1,000 or greater) with amines (e.g., polyalkyl polyamines, polyalkenyl polyamines, aromatic amines, carboxylic acid-substituted polyamines and the succinimide formed from any one of these with an olefinic succinic acid or anhydride) and carbonyl compounds (e.g., formaldehyde or para formaldehyde). Most such high molecular weight dispersants, e.g., molecular weight greater than 2,000, may receive the enhanced stability to phase separation in "ad packs" by being combined with the salts of this invention.

Hydroxyamines which can be reacted with the long chain hydrocarbon substituted dicarboxylic acid material mentioned above to form dispersants include 2-amino-1-butanol, 2-amino-2-methyl-1-propanol, p-(beta-hydroxyethy 1)-aniline, 2-amino-1-propanol, 3-amino-1-propanol, 2-amino-2-methyl-1, 3-propanediol, 2-amino-2-ethyl-1,3-propanediol, N-(beta- hydroxy propyl)-N'-(beta-aminoethyl)-piperazine, tris (hydroxy methyl) aminomethane (also known as trismethylolaminomethane), ethanolamine, beta-(beta-hydroxyethoxy)-ethylamine, and the like. Mixtures of these or similar amines can also be employed.

A very suitable diapersant is one derived from polyisobutylene substituted with succinic anhydride groups and reacted with polyethylene areinca, e.g., tetraethylene pentamine, pentaethylene hexamine, polyoxyethylene and polyoxypropylene areinca, e.g., polyoxypropylene aliamine, trismethylolaminomethane and pentaerythritol, and combinations thereof. One preferred diapersant combination involves a combination of (A) polyisobutene substituted with succinic anhydride groups and reacted with (B) a hydroxy compound, e.g., pentaerythritol, (C) a polyoxyalkylene polyamine, e.g., polyoxypropylene diamine, and (D) a polyalkylene polyamine, e.g., polyethylene diamine and tetraethylene pentamine using about 0.3 to about 2 moles each of (B) and (D) and about 0.3 to about 2 moles of (C) per mole of (A) as described in U.S. Pat. No. 3,804,763. Another preferred dispersant combination involves the combination of (A) polyisobutenyl succinic anhydride with (B) a polyalkylene polyamine, e.g., tetraethylene pentamine, and (C) a polyhydric alcohol or polyhydroxy-substituted aliphatic primary amine, e.g., pentaerythritol or trismethylolaminomethane as described in U.S. Pat. No. 3,632,511.

DETERGENTS

Metal-containing rust inhibitors and/or detergents are frequently used with ashless dispersants. Such detergents and rust inhibitors include oil soluble mono-and di-carboxylic acids, the metal salts of sulfonic acids, alkyl phenols, sulfurized alkyl phenols, alkyl salicylates and napthenates. Highly basic (or "overbased") metal salts, which are frequently used as detergents, appear particularly prone to interaction with the ashless dispersant. Usually these metal-containing rust inhibitors and detergents are used in lubricating oil in amounts of about 0.01 to 10, e.g., 0.1 to 5, weight percent, based on the weight of the total lubricating composition.

Highly basic alkaline earth metal sulfonates are frequently used as detergents. They are usually produced by heating a mixture comprising an oil-soluble sulfonate or alkaryl sulfonic acid, with an excess of alkaline earth metal compound above that required for complete neutralization of any sulfonic acid present and thereafter forming a dispersed carbonate complex by reacting the excess metal with carbon dioxide to provide the desired overbasing. The sulfonic acids are typically obtained by the sulfonation of alkyl substituted aromatic hydrocarbons such as those obtained from the fractionation of petroleum by distillation and/or extraction or by the alkylation of aromatic hydrocarbons as for example those obtained by alkylating benzene, toluene, xylene, napthalene, diphenyl and the halogen derivatives such as chlorobenzene, chlorotoluene and chloronaphthalene. The alkylation may be carried out in the presence of a catalyst with alkylating agents having from about 3 to more than 30 carbon atoms. For example, haloparaffins, olefins obtained by dehydrogenation of paraffins, polyolefin polymers produced from ethylene, propylene, etc., are all suitable. The alkaryl sulfonates usually contain from about 9 to about 70 or more carbon atoms, preferably from about 16 to about 50 carbon atoms per alkyl substituted aromatic moiety.

The alkaline earth metal compounds which may be used in neutralizing these alkaryl sulfonic acids to provide the sulfonates includes the oxides and hydroxides, alkoxides, carbonates, carboxylate, sulfide, hydrosulfide, nitrate, borates and ethers of magnesium, calcium, strontium and barium. Examples are calcium oxide, calcium hydroxide, magnesium oxide, magnesium acetate and magnesium borate. As noted, the alkaline earth metal compound is used in excess of that required to complete neutralization of the alkaryl sulfonic acids. Generally, the amount ranges from about 100 to 220 percent, although it is preferred to use at least 125 percent of the stoichiometric amount of metal required for complete neutralization.

Various other preparations of basic alkaline earth metal alkaryl sulfonates are known, such as U.S. Pat. Nos. 3,150,088 and 3,150,089 wherein overbasing is accomplished by hydrolysis of an alkoxide-carbonate complex with the alkaryl sulfonate in a hydrocarbon solvent-diluent oil.

A preferred alkaline earth sulfonate additive is magnesium alkyl aromatic sulfonate having a high total base number ("TBN") ranging from about 300 to about 400 with the magnesium sulfonate content ranging from about 25 to about 32 weight percent, based upon the total weight of the additive system dispersed in mineral lubricating oil.

Neutral metal sulfonates are frequently used as rust inhibitors. Polyvalent metal alkyl salicylate and naphthenate materials are known additives for lubricating oil compositions to improve their high temperature performance and to counteract deposition of carbonaceous matter on pistons (U.S. Pat. No. 2,744,069). An increase in reserve basicity of the polyvalent metal alkyl salicylates and napthenates can be realized by utilizing alkaline earth metal, e.g., calcium, salts of mixtures of $C_8$–$C_{26}$ alkyl salicylates and phenates (see '069) or polyvalent metal salts of alkyl salicylic acids, said acids obtained from the alkylation of phenols followed by phenation, carboxylation and hydrolysis (U.S. Pat. No. 3,704,315) which could then be converted into highly basic salts by techniques generally known and used for such conversion. The reserve basicity of these metal-containing rust inhibitors is usefully at TBN levels of between 60 and 150. Included with the useful polyvalent metal salicylate and naphthenate materials are the methylene and sulfur bridged materials which are readily derived from alkyl substituted salicylic or naphthenic acids or mixtures of either of both with alkyl substituted phenols. Basic sulfurized salicylates and a method for their preparation is shown in U.S. Pat. No. 3,595,791. Such materials include alkaline earth metal, particularly magnesium, calcium, strontium and barium salts of aromatic acids having the general formula:

$$HOOC—ArR_1—Xy(ArR_1IOH)_n$$

where Ar is an aryl radical of 1 to 6 rings, $R_1$ is an alkyl group having from about 8 to 50 carbon atoms, preferably 12 to 30 carbon atoms (optimally about 12), X is a sulfur (—S—) or methylene (—$CH_2$—) bridge, y is a number from 0 to 4 and n is a number from 0 to 4.

Preparation of the overbased methylene bridged salicylate-phenate salt is readily carried out by conventional techniques such as by alkylation of a phenol followed by phenation, carboxylation, hydrolysis, methylene bridging a coupling agent such as an alkylene dihalide followed by salt formation concurrent with carbonation. An overbased calcium salt of a methylene bridged phenol-salicylic acid of the general formula:

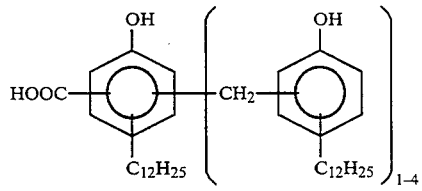

with a TBN of 60 to 150 is highly useful in this invention.

Another type of basic metal detergent, the sulfurized metal phenates, can be considered a metal salt whether neutral or basic, of a compound typified by the general formula:

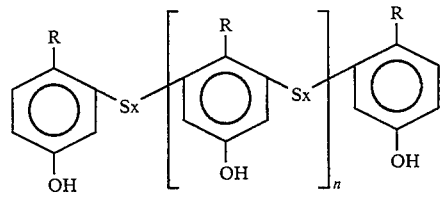

where x=1 or 2, n=0, 1 or 2 or a polymeric form of such a compound, where R is an alkyl radical, n and x are each integers from 1 to 4, and the average number of carbon atoms in all of the R groups is at least about 9 in order to ensure adequate solubility in oil. The individual R groups may each contain from 5 to 40, preferably 8 to 20, carbon atoms. The metal salt is prepared by reacting an alkyl phenol sulfide with a sufficient quantity of metal containing material to impart the desired alkalinity to the sulfurized metal phenate.

Regardless of the manner in which they are prepared, the sulfurized alkyl phenols which are useful generally contain from about 2 to about 14 percent by weight, preferably about 4 to about 12 weight percent sulfur based on the weight of sulfurized alkyl phenol.

The sulfurized alkyl phenol may be converted by reaction with a metal containing material including oxides, hydroxides and complexes in an amount sufficient to neutralize said phenol and, if desired, to overbase the product to a desired alkalinity by procedures well known in the art. Preferred is a process of neutralization utilizing a solution of metal in a glycol ether.

The neutral or normal sulfurized metal phenates are those in which the ratio of metal to phenol nucleus is about 1:2. The "overbased" or "basic" sulfurized metal phenates are sulfurized metal phenates wherein the ratio of metal to phenol is greater than that of stoichiometric, e.g., basic sulfurized metal dodecyl phenate has a metal content up to (or greater) than 100 percent in excess of the metal present in the corresponding normal sulfurized metal phenates. The excess metal is produced in oil-soluble or dispersible form (as by reaction with $CO_2$).

ANTIWEAR ADDITIVES

Dihydrocarbyl dithiophosphate metal salts are frequently added to lubricating oil compositions as antiwear agents. They also provide antioxidant activity. The zinc salts are most commonly used in lubricating oil in amounts of 0.1 to 10, preferably 0.2 to 2 weight percent, based upon the total weight of the lubricating oil composition. They may be prepared in accordance with known techniques by first forming a dithiophosphoric acid, usually by reaction of an alcohol or a phenol with $P_2S_5$ and then neutralizing the dithiophosphoric acid with a suitable zinc compound.

Mixtures of alcohols may be used including mixtures of primary and secondary alcohols, secondary generally for importing improved antiwear properties, with primary giving improved thermal stability properties. Mixtures of the two are particularly useful. In general, any basic or neutral zinc compound could be used but the oxides, hydroxides and carbonates are most generally employed. Commercial additives frequently contain an excess of zinc due to use of an excess of the basic zinc compound in the neutralization reaction.

The zinc dihydrocarbyl dithiophosphates useful in the present invention are oil soluble salts of dihydrocarbyl esters of dithiophosphoric acids and may be represented by the following formula:

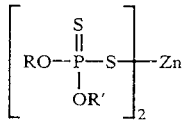

wherein R and R′ may be the same or different hydrocarbyl radicals containing from 1 to 18, preferably 2 to 12 carbon atoms and including radicals such as alkyl, alkenyl, arylaralkyl, alkaryl and cycloaliphatic radicals. Particularly preferred as R and R′ groups are alkyl groups of 2 to 8 carbon atoms. Thus, the radicals may, for example, be ethyl, n-propyl, i-propyl, n-butyl, i-butyl, sec- butyl, amyl, n-hexyl, i-hexyl, n-octyl, decyl, dodecyl, octadecyl, 2-ethylhexyl, phenyl, butyl-phenyl, cyclohexyl, methylcyclopentyl, propenyl, butenyl, etc. In order to obtain oil solubility, the total number of carbon atoms (i.e., R and R′) in the dithiophosphoric acid generally should be about 5 or greater.

ANTIOXIDANTS

A material which has been used as an antioxidant in lubricating oil compositions containing a zinc dihydrocarbyl dithiophosphate and ashless dispersant is copper, in the form of a synthetic or natural carboxylic acid salt. Examples include $C_{10}$ to $C_{18}$ fatty acids such as stearic or palmitic acid. But unsaturated acids (such as oleic acid), branched carboxylic acids (such as naphthenic acids) of molecular weight from 200 to 500 and, synthetic carboxylic acids are all used because of the acceptable handling and solubility properties of the resulting copper carboxylates.

Suitable oil soluble dithiocarbamates have the general formula $(RR'NCSS)_nCu$; where n is 1,2 and R and R′ may be the same or different hydrocarbyl radicals containing from 1 to 18 carbon atoms and including radicals such as alkyl, alkenyl, aryl, aralkyl, alkaryl and cycloaliphatic radicals. Particularly preferred as R and R′ groups are alkyl groups of 2 to 8 carbon atoms. Thus, the radicals may, for example, be ethyl, n-propyl, n-butyl, i-butyl, sec-butyl, amyl, n-hexyl, i-hexyl n-octyl, decyl, dodecyl, octadecyl, 2-ethylhexyl, phenyl butyl-phenyl, cyclohexyl, methylcyclopentyl, propenyl, butenyl, etc. In order to obtain oil solubility, the total number of carbon atoms (i.e., R and R′) generally should be about 5 or greater.

Copper sulfonates, phenates and acetyl acetonates can also be used.

These antioxidants are used in amounts such that, in the final lubricating or fuel composition, a copper concentration of from about 5 to about 500 ppm is present.

The hydrocarbyl succinic acid metal salts used in this invention may be used in place of at least a portion of these antioxidants.

HYDROCARBYL SUCCINIC ACID METAL SALTS

The metal salts suitable for use in this invention include those materials having metals from Groups 1b, 2b, 3b, 4b, 5b, 6b, 7b and 8 of the Periodic Table (e.g., Li, Na, K, Rb, Cs, Mg, Ca, Sr, 8a, Cu, Cd, Zn). Preferred are metals from Groups 1*b* and 2b. Most preferred is copper, whether in the cuprous or cupric ion form, and zinc.

The salts themselves may be basic, neutral or acidic. They may be formed by reacting (a) any of the materials discussed above in the Diapersant section, which have at least one free carboxylic acid group with (b) a reactive metal compound. Suitable reactive metal corn pounds include those such as cuptic or cuprous hydroxides, oxides, acetates, borates, and carbonates, basic copper carbonate or the corresponding zinc compounds.

Examples of the metal salts of this invention are Cu and Zn salts of polyisobutenyl succinic anhydride (hereinafter referred to as Cu-PIBSA and Zn-PIBSA, respectively), and Cu and Zn salts of polyisobutenyl succinic acid. Preferably, the selected metal employed is its divalent form, e.g., $Cu^{+2}$. The preferred substrates are polyalkenyl succinic acids in which the alkenyl group has a molecular weight greater than about 700. The alkenyl group desirably has a $M_n$ from about 900 to 1400, and up to 2500, with a $M_n$ of about 950 being most preferred. Especially preferred, of those listed above in the section on Dispersants, is polyisobutylene succinic acid (PIBSA). These materials may desirably be dissolved in a solvent, such as a mineral oil, and heated in the presence of a water solution (or slurry) of the metal bearing material. Heating may take place between 70° and about 200° C. Temperatures of 110° to 140° C. are entirely adequate. It may be necessary, depending upon the salt produced, not to allow the reaction mixture to remain at a temperature above about 140° C. for an extended period of time, e.g., longer than 5 hours, or decomposition of the salt may occur.

The metal salts of this invention (e.g., Cu-PIBSA, Zn-PIBSA, or mixtures thereof) will be generally employed in an amount of from about 1–1,000 ppm by weight of the metal, and preferably from about 50–500 ppm by weight of the metal, in the final lubricating or fuel composition.

This invention will be further understood by reference to the following examples, wherein all parts are parts by weight, unless otherwise noted. The examples are intended only to exemplify the invention and are not to be considered to limit it in any way.

EXAMPLES

Example 1 (Production of PIBSA)

A polyisobutenyl succinic anhydride (PIBSA) was prepared from a polyisobutylene (PIB) molecule of 1,300 $M_n$ by heating a mixture of 100 parts of polyisobutylene with 13.5 parts of maleic anhydride to a temperature of about 220° C. When the temperature reached 120° C., the chlorine addition was begun and 8.3 parts of chlorine at a constant rate was added to the hot mixture for about 5.5 hours. The reaction mixture was then heat soaked at 220° C. for about 1.5 hours and then stripped with nitrogen for about one hour.

The PIBSA product was 83.8 weight percent active ingredient (a.i.), the remainder being primarily unreacted PIB. The product was then diluted with S 150 N to an ASTM Saponification Number of 69 and an a.i. of 59.

Example 2 (Production of Cu-PIBSA)

About 423.7 g of a 59 weight % oil solution of the PIBSA prepared as described in Example 1 was mixed with 52 g of cuptic acetate, 577 g of mineral oil solvent 150 neutral and 15 ml of water. The reaction mixture was slowly heated to 90° C. and soaked at this temperature for 4 hours. Thereafter, the reaction mixture was heated to 130° C. and nitrogen sparged for one hour. The oil solution was filtered while hot. The 26.5 weight active ingredient analyzed for 1.25 weight % copper.

Example 3 (Production of Zn-PIBSA)

About 1250 g of a 59 weight % oil solution of the PIBSA prepared in Example 1 was charged into a 5 liter reaction flask. About 2250 g of S 150 N mineral oil was added along with 20 ml of water and 171.37 g of zinc acetate. The reaction mixture was then slowly heated to 100° C. and soaked at this temperature for 2 hours. The temperature was raised to 130° C., and the reaction mixture nitrogen stripped for 1 hour. The oil solution was filtered. The 22.5% active ingredient oil solution contained 1.42 weight % Zn.

Example 4 (Stability of Concentrates Containing Cu-PIBSA)

Several concentrates intended for use in lubricating oil compositions were blended using either copper oleate antioxidant and PIBSA or a copper oleate antioxidant and a Cu-PIBSA to demonstrate the superior stability which is provided by use of the Cu-PIBSA.

The concentrates were blended such that, when diluted with a basestock oil, they would be usable as fully formulated lubricants. Each concentrate blend contained about equal amounts of a PIBSA-polyamine dispersant, overbased magnesium sulfonate detergent, ZDDP, nonylphenol sulfide, and friction modifier together with the components listed below by weight %:

| Component | Base Case | Conc. #1 | Conc. #2 |
|---|---|---|---|
| Dispersant<br>Detergent<br>ZDDP<br>Nonylphenol Sulfide<br>Friction Modifiers<br>Diluent Oil | 93.7 | 95.7 | 95.9 |
| Cupric Oleate (4% Cu) | 4.4 | 3.0 | 2.0 |
| Product of Example 2 | 0 | 1.3 | 2.1 |
| Product of Example 1 | 1.9 | 0 | 0 |

This resulted in an equivalent copper content (on a metal basis) in each of the following concentrates:

| | Base Case | Conc. #1 | Conc. #2 |
|---|---|---|---|
| Weight Percent Cu From Oleate | 0.178 | 0.119 | 0.078 |
| Weight Percent Cu From Cu—PIBSA | 0.000 | 0.060 | 0.099 |
| Total | 0.178 | 0.179 | 0.177 |

These three concentrates were subjected to a stability test at two elevated temperatures. This test is designed to simulate extended storage of the concentrate at the maximum allowable temperature, these conditions being most conducive to concentrate sedimentation or haze development.

The results were as follows:

| | Base Case | Conc. #1 | Conc. #2 |
|---|---|---|---|
| At 130° F., Days Stable | <2 | >70 | >70 |
| At 150° F., Days Stable | <2 | >10 | >70 |

It is therefore clear that replacement of the copper oleate with the product of Example 2 provided substantial improvement over use of the copper oleate alone. Furthermore, the product of Example 2 was substantially more effective at stabilizing the concentrate than was the PIBSA by itself at equivalent copper concentrations.

Example 5 (Stability of Concentrates Containing Zn-PIBSA)

The concentrates of Example 4 were blended as described in that Example with the exception that the two blends contained the same copper oleate concentration and various levels of either PIBSA or Zn-PIBSA instead of the Cu-PIBSA.

| Component-Wt. % | Base Case | Conc. #3 | Conc. #4 |
|---|---|---|---|
| Dispersant<br>Detergent<br>ZDDP | | | |

-continued

| Component-Wt. % | Base Case | Conc. #3 | Conc. #4 |
|---|---|---|---|
| Nonylphenol Sulfide Friction Modifiers Diluent Oil | 93.7 | 94.5 | 94.0 |
| Copper Oleate | 4.4 | 4.4 | 4.3 |
| Product of Example 3 | 0 | 1.1 | 1.7 |
| Product of Example 1 | 1.9 | 0 | 0 |

The results were as follows:

| | Base Case | Conc. #1 | Conc. #2 |
|---|---|---|---|
| At 130° F., Days Stable | <2 | <2 | >70 |
| At 190° F. Days Stable | <2 | <2 | 20 |

The product of Example 3 provides better compatibility and stability than does the PIBSA alone and does so at a lower concentration.

We claim as our invention:

1. A composition comprising:

a nitrogen- or ester-containing dispersant material selected from the group of (i) dispersant derived from reaction of an amine compound or a hydroxy compound and a hydrocarbyl substituted monounsaturated mono- or dicarboxylic acid producing reaction product formed by reacting olefin polymer of $C_2$ to $C_{10}$ monoolefin having a number average molecular weight greater than about 900 and acrylic acid or a $C_4$ to $C_{10}$ monounsaturated mono- or dicarboxylic acid material or, (ii) a high molecular weight Mannich base dispersant derived from a hydrocarbyl substituted mono- or polyhydroxy benzene having a molecular weight greater than about 1,000, (b) a high total base number detergent material, (c) a zinc dihydrocarbyl dithiophosphate antiwear material, (d) a compatibilizing material of a copper salt of a hydrocarbyl substituted monounsaturated mono- or dicarboxylic acid producing reaction product, which reaction product is formed by reacting olefin polymer of $C_2$ to $C_{10}$ monoolefin having a number average molecular weight greater than about 700 and acrylic acid or a $C_4$ to $C_{10}$ monounsaturated mono- or dicarboxylic acid material, and (e) a copper antioxidant.

2. The composition of claim 1 wherein the olefin polymer used to produce the compatibilizing material has a number average molecular weight between about 900 and about 2,500.

3. The composition of claim 2 wherein the olefin polymer used to produce the compatibilizing material has a number average molecular weight between about 900 and about 1,400.

4. The composition of claim: 1 wherein said copper antioxidant comprises a low molecular weight carboxylate copper salt.

5. The composition of claim 4 wherein the copper antioxidant comprises copper oleate.

6. The composition of claim 5 wherein said copper oleate is employed in an amount sufficient to provide from about 5 to about 500 ppm of added copper in said composition.

7. The composition of claim 4 wherein said copper antioxidant comprises a low molecular weight carboxylate copper salt.

8. The composition of claim 2 wherein the copper antioxidant comprises copper oleate and wherein said copper oleate is employed in an amount sufficient to provide from about 5 to about 500 ppm of added copper in said composition.

9. The composition of claim 6 wherein the copper antioxidant comprises copper oleate which is employed in an amount sufficient to provide from about 5 to about 500 ppm of added copper in said composition.

10. A composition comprising:

(a) a nitrogen-containing dispersant material comprising the reaction product of: (i) a hydrocarbyl substituted monounsaturated dicarboxylic acid producing reaction product formed by reacting olefin polymer of isobutylene having a number average molecular weight greater than about 900 and maleic anhydride, and (ii) a basic polyamine reactant, (b) an overbased magnesium sulfonate detergent material, (c) zinc dihydrocarbyl dithiophosphate antiwear material, (d) a compatibilizing material comprising a copper salt of a hydrocarbyl substituted monounsaturated dicarboxylic acid producing reaction product, which reaction product is formed by reacting an olefin polymer of isobutylene monoolefin having a number average molecular weight of about 950 and maleic anhydride, said copper salt being employed in an amount of from about 50 to 500 ppm by weight of said copper metal, and (e) a copper antioxidant, said copper antioxidant being employed in an amount sufficient to provide from about 5 to about 500 ppm by weight of added copper in said composition, said copper antioxidant comprising a copper salt of a $C_{10}$ to $C_{13}$ fatty acid, a copper salt of a naphthenic acid of molecular weight from 200 to 500, a copper dithiocarbamate, copper sulfonate, copper phenate or copper acetyl acetonate.

11. The composition of any one of claims 1 or 10, wherein before forming the copper salt, said dicarboxylic acid producing reaction product is further reacted with a member selected from the group consisting of amines, alcohols and amino-alcohols.

12. The composition of claim 11 wherein the alcohol is a polyol.

13. The composition of claim 11 wherein said amines are selected from the group consisting of mono- and polyamines of about 2 to 60 total carbon atoms and about 2 to 12 nitrogen atoms in a molecule.

14. The composition of claim 13, wherein the molecule contains about 3 to 20 carbon atoms and about 2 to 8 nitrogen atoms.

15. The composition of claim 11, wherein said amines are selected from hydrocarbyl amines, and hydrocarbyl amines substituted with at least one member of the group consisting of an hydroxy group, an alkoxy group, an amide group, a nitrile and an imidazoline group.

16. The composition of claim 11, wherein said amine is an hydroxy amine with 1 to 6 hydroxy groups.

17. The composition of claim 11, wherein said amine is an hydroxy amine with 1 to 3 hydroxy groups.

18. The composition of any one of claim 1 or 10, wherein before forming the copper salt, said dicarboxylic acid producing reaction product is further reacted with an aliphatic saturated amine having the general formula

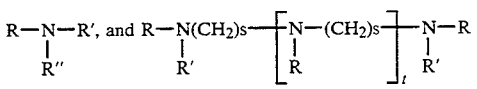

wherein R, R′ and R″ are independently selected from the group consisting of, hydrogen; $C_1$ to $C_{25}$ straight or branched chain alkyl radicals; $C_1$ to $C_{12}$ alkoxy; $C_2$ to $C_6$ alkylene radicals; $C_2$ to $C_{12}$ alkylamino; $C_2$ to $C_6$ alkylene radicals; each s can be the same or a different number from 2 to 6; and t is a number of from 0 to 12, with at least one of R, R′ or R″ being a hydrogen atom.

19. The composition of claim 18 wherein said aliphatic saturated amine is an alkylene polyamine.

20. The composition of claim 19 wherein said alkylene polyamine contains from 5 to 7 nitrogen atoms per molecule.

21. A process for forming a lubricating oil concentrate having improved storage stability, said concentrate comprising:

(a) a nitrogen- or ester-containing dispersant material selected from the group of (i) dispersant derived from reaction of an amine compound or a hydroxy compound and a hydrocarbyl substituted monounsaturated mono- or dicarboxylic acid producing reaction product formed by reacting olefin polymer of $C_2$ to $C_{10}$ monoolefin having a number average molecular weight greater than about 900 and acrylic acid or a $C_4$ to $C_{10}$ monounsaturated mono- or dicarboxylic acid material or, (ii) a high molecular weight Mannich base dispersant derived from a hydrocarbyl substituted mono- or polyhydroxy benzene having a molecular weight greater than about 1,000, (b) a high total base number detergent material, (c) a zinc dihydrocarbyl dithiophosphate antiwear material, and (d) a copper antioxidant, which comprises admixing with said concentrate a compatibilizing material comprising a copper salt of a hydrocarbyl substituted monounsaturated mono- or dicarboxylic acid producing reaction product, which reaction product is formed by reacting olefin polymer of $C_2$ to $C_{10}$ monoolefin having a number average molecular weight greater than about 700 and acrylic acid or a $C_4$ to $C_{10}$ monounsaturated mono- or dicarboxylic acid material.

22. The process of claim 21 wherein the olefin polymer used to produce the compatibilizing materials has a number average molecular weight between about 900 and about 2,500.

23. The process of claim 22 wherein the olefin polymer used to produce the compatibilizing material has a number average molecular weight between about 900 and about 1,400.

24. The process of claim 21 wherein said copper antioxidant comprises a low molecular weight carboxylate copper salt.

25. The process of claim 24 wherein the copper antioxidant comprises copper oleate.

26. The process of claim 25 wherein said copper oleate is employed in an amount sufficient to provide from about 5 to about 500 ppm of added copper in said composition.

27. The process of claim 24 wherein said copper antioxidant comprises a copper salt of a $C_{10}$ to $C_{13}$ fatty acid, a copper salt of a naphthenic acid of molecular weight from 200 to 500, a copper dithiocarbamate, a copper sulfonate, a copper phenate or a copper acetyl acetonate.

28. The process of claim 21 wherein before forming the copper salt, said dicarboxylic acid producing reaction product is further reacted with a member selected from the group consisting of amines, alcohols and amino-alcohols.

29. The process of claim 28 wherein the alcohol is a polyol.

30. The process of claim 28, wherein said amines are selected from the group consisting of mono- and polyamines of about 2 to 60 total carbon atoms and about 2 to 12 nitrogen atoms in a molecule.

31. The process of claim 30, wherein the molecule contains about 3 to 20 carbon atoms and about 2 to 8 nitrogen atoms.

32. The process of claim 28, wherein said amines are selected from hydrocarbyl amines, and hydrocarbyl amines substituted with at least one member of the group consisting of an hydroxy group, an alkoxy group, an amide group, a nitrile and an imidazoline group.

33. The process of claim 28, wherein said amine is an hydroxy amine with 1 to 6 hydroxy groups.

34. The process of claim 28, wherein said amine is an hydroxy amine with 1 to 3 hydroxy groups.

35. The process of claim 28, wherein said amine is an hydroxy amine with 1 to 3 hydroxy groups.

36. The process of any one of claims 21 or 28 wherein before forming the metal salt, said dicarboxylic acid producing reaction product is further reacted with an aliphatic saturated amine having the general formula

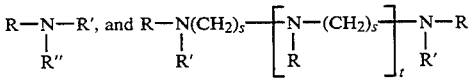

wherein R, R′ and R″ are independently selected from the group consisting of; hydrogen; $C_1$ to $C_{25}$ straight or branched chain alkyl radicals; $C_1$ to $C_{12}$ alkoxy; $C_2$ to $C_6$ alkenylene radicals; $C_2$ to $C_{12}$ alkylamino; $C_2$ to $C_6$ alkylene radicals; each s can be the same or a different number from 2 to 6; and t is a number of from 0 to 12, with at least one of R,, R′ or R″ being a hydrogen atom.

37. The process of claim 36 wherein said aliphatic saturated amine is an alkylene polyamine.

38. The process of claim 37 wherein said alkylene polyamine contains from 5 to 7 nitrogen atoms per molecule.

* * * * *

UNITED STATES PATENT AND TRADEMARK OFFICE

CERTIFICATE OF CORRECTION

PATENT NO. : 5,439,604

DATED : August 8, 1995

INVENTOR(S) : Waddoups et al

It is certified that error appears in the above-indentified patent and that said Letters Patent is hereby corrected as shown below:

Column 16, line 1, claim 7, should depend from claim 2 not claim 4--.

line 9, claim 9 should depend from claim 3 not claim 6;
and line 23, "(c) zinc" should read --(c) a zinc--.

Column 18, line 54, "alkenylene radicals" should read --alkylene radicals--.

Signed and Sealed this

Sixteenth Day of April, 1996

Bruce Lehman

*Attest:*

BRUCE LEHMAN

*Attesting Officer*

*Commissioner of Patents and Trademarks*